US006106453A

United States Patent [19]

Sinn et al.

[11] Patent Number: 6,106,453

[45] **Date of Patent: *Aug. 22, 2000**

[54] METHOD USING PUNCHING AND SCORING TOOL FOR PRODUCTION OF SCORED PUNCHED PARTS

[75] Inventors: Rolf Sinn, Leingarten; Wolfgang Grebe, Lechbruck, both of Germany

[73] Assignee: Karl Marbach GmbH & Co., Heilbronn, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/800,829

[22] Filed: Feb. 13, 1997

[30] Foreign Application Priority Data

Feb. 16, 1996 [DE] Germany ..... 196 05 850
Mar. 18, 1996 [DE] Germany ..... 196 10 574

[51] Int. Cl.[7] ..... B31B 1/20

[52] U.S. Cl. ..... 493/473; 493/354; 493/472; 83/55

[58] Field of Search ..... 83/862, 55; 493/59, 493/61, 62, 473, 340, 363, 372, 60, 324, 353, 354, 472, 355; 76/107.8

[56] References Cited

U.S. PATENT DOCUMENTS

| | | | |
|---|---|---|---|
| 360,674 | 4/1887 | Fiske | 76/107.8 X |
| 1,661,807 | 3/1928 | Messmer | 69/2 |
| 2,095,359 | 10/1937 | Dudley | 493/372 X |
| 2,663,180 | 12/1953 | Benedict | 69/2 |
| 3,043,165 | 7/1962 | Tracey et al. | 76/107.8 |
| 4,100,844 | 7/1978 | Spengler | 493/472 |
| 4,112,827 | 9/1978 | Kang | 76/107.8 X |
| 4,850,950 | 7/1989 | Holliday | 493/475 |
| 5,176,613 | 1/1993 | Cavlin et al. | 83/862 X |

FOREIGN PATENT DOCUMENTS

| | | | |
|---|---|---|---|
| 2315368 | 6/1976 | France . | |
| 2365590 | 9/1975 | Germany | 493/372 |
| 3831393C2 | 6/1990 | Germany . | |
| 3928916C1 | 1/1991 | Germany . | |
| 9002692 | 7/1992 | Netherlands . | |

*Primary Examiner*—Clark F. Dexter
*Attorney, Agent, or Firm*—Rothwell, Figg, Ernst & Manbeck

[57] ABSTRACT

In the method for production of scored punched parts from a material sheet by a punching and scoring tool the formation of scores in the material sheet is started before the punching process is initiated. The punching and scoring tool has a carrier board, on the underside of which punching elements and scoring elements are provided, and a punching/scoring plate under the carrier board, in which scoring grooves are formed under the scoring elements. The scoring elements in an initial position, in which the scoring elements and punching elements are arranged at a distance from the punching/scoring plate, project further from the carrier board towards the punching/scoring plate than the punching elements. The scoring elements are also mounted flexibly on the carrier board in the lifting direction.

2 Claims, 2 Drawing Sheets

METHOD USING PUNCHING AND SCORING TOOL FOR PRODUCTION OF SCORED PUNCHED PARTS

BACKGROUND OF THE INVENTION

1. Field of the Invention

This invention relates to a method as well as a punching and scoring tool for production of scored punched parts.

2. Description of the Related Art

Cardboard folding box blanks are usually provided with scores, which give the folding boxes their defined shape when they are subsequently erected. The contours as well as necessary incisions in the folding box blank are produced by punching. Manufacture is by strip steel punching and scoring tools on flat-bed or rotary punches.

The strip steel punching and scoring tools usually consist of a carrier board made e.g. from wood, composites of plastics with glass fabric or reinforced with metal plates in sandwich construction. Slots to receive punching or scoring rules are provided in these carrier boards according to the box contours. The punching rules project exactly as far as or further than the scoring rules from the carrier board. The punching rules operate against a punching plate made in most instances from steel. The scoring rules produce a scoring ridge in the folding box material by forcing the latter into a scoring groove. These scoring grooves can be cut into the punching plate or mounted as an attachment on the punching plate. The scores and punching contours are produced with a single punching stroke in this way, the scores being shaped only when the punching rules have started the punching process. Such tools are described, for example, in patents DE 39 28 916 C1 or DE 38 31 393 A1.

The punching and scoring process is problematical in the already known punching and scoring tools, because the material is drawn into the corresponding scoring groove by the scoring rule only when the punching process has already started, i.e. when the punching rules have already penetrated the cardboard.

As a result of drawing the material into the scoring groove, travel extension of theoretically up to about 50% compared to the scoring groove width is required. The scoring rule attempts to obtain this additional material laterally. However, this is possible only to a limited extent, because the punching rules hold the material firmly. This process is all the more problematical the closer parallel punching and scoring rules are to each other. If the punching rules rest on the material, the latter is fixed, the blade cutting edge drawing in material in the compression phase until the material is finally cut through, so that the material inflow for formation of the scoring ridge is greatly impeded. As not enough material can flow behind, tensile stresses occur at the cutting points, because the scoring rules also attempt to obtain material while they enter the scoring groove. The tensile stresses in the material thus cause the cutting process to become a cutting/tearing process, which has a negative effect on the cutting quality. The scoring ridge is in turn subject to tensile stresses, which are caused by the adjacent cutting rules. As punching and scoring rules are arranged symmetrically in a folding box blank only in exceptional cases, the tensile stresses acting on the scoring ridge are usually asymmetrical, which leads to asymmetry or inclination of the scoring ridge according to the distance from the adjacent rules and greatly impairs the folding behaviour. The limits of the punchability and scorability are consequently predetermined according to the punched material and the folding box geometry. In particular the quality of the scoring ridge is of crucial importance for the subsequent folding processes in high-speed folding box gluing and packing machines.

SUMMARY OF THE INVENTION

It is the object of the invention to provide a method as well as a punching and scoring tool, with which scored punched parts with a high score quality can be produced.

This object is obtained by a method for production of scored punched parts made from a material sheet by means of a punching and scoring tool, on which scoring and punching means, which can be moved in a lifting movement in relation to a counter-punching plate for formation of scores in the material sheet and for punching the material sheet, respectively, are provided, material from the sheet being drawn into scoring grooves during formation of the scores, wherein formation of scores in the material sheet is started before the punching process is initiated.

The punching process is preferably initiated when the material has been drawn into the scoring grooves.

In the method according to the invention the punching rules contact the material sheet only after engagement of the scoring rules, preferably only when the material has been drawn into the scoring groove by the scoring rules. Consequently stresses in the material during formation of the scores are avoided, so that the scores have a high quality.

The method according to the invention can best be carried out with a punching and scoring tool comprising

- a carrier board, on the underside of which punching elements and scoring elements are provided,
- a punching/scoring plate, in which scoring grooves are formed under the scoring elements, provided under the carrier board,
- the punching/scoring plate being movable in a lifting movement in relation to the carrier board, wherein

- the scoring elements in an initial position, in which the scoring elements and the punching elements are arranged at a distance from the punching/scoring plate, project further from the carrier board towards the punching/scoring plate than the punching elements and
- the scoring elements are mounted resiliently on the carrier board in the lifting direction.

In the punching and scoring tool according to the invention the rigid link between punching and scoring is eliminated, so that scoring and punching can be performed at different times in one working stroke. The carrier board thus has only the slots for the punching rules. The rigidity of the entire tool is thus clearly increased.

The compression of the material in the score area can be adjusted by suitable selection of the spring constant or spring characteristic of the resilient means, depending on the type of material, the thickness of the cardboard to be scored and the depth of the scoring groove.

The scoring elements can rest resiliently on the material to be scored, so that a uniform, constant scoring depth can be achieved independently of the punching element wear.

The geometrical conditions such as the difference in height between punching and scoring elements depend on the thickness of the punched material and the scoring parameters, i.e. the scoring groove depth in relation to the material thickness, from which material compression important for formation of the scoring ridge is derived. The folding edge of the boxes is fixed by the compressed impression of the scoring elements. The possibility of compression can be used here for the first time, because punching and scoring elements operate independently of each other and the wear of the punching elements in the course of production does not affect the ratio of the punching/scoring element heights, as was previously inevitably the case in the punching/scoring tools. It also has the advantage that the scoring groove depths in the punching/scoring plate can be produced at lower cost. Furthermore, the scores can be kept narrower. This is highly advantageous for the folding edges of the folding boxes.

The scoring elements are preferably formed by scoring projections on the underside of a scoring plate, which is mounted resiliently on or in the carrier board.

The scoring plate is advantageously mounted on the carrier board by an elastomer plate arranged between the scoring plate and the carrier board.

For accurate fixing the scoring plate can be guided in the lifting direction by centring pins secured to the carrier board.

If one scoring plate is provided for each scored punched part, the accurate positioning depends only on the production and assignment to the scoring groove of the individual scoring plates. This has an important advantage. The scoring grooves are incorporated in the punching/scoring plates by numerical control with the same program as the slots for the punching/scoring rules in the carrier board. However, driving of the rules into the slots produces stresses, which lead to deviations of the dimensions of the scoring rules in the carrier board and the scoring grooves in the punching/scoring plate, so that the scoring rules have to be re-adjusted by hand, i.e. at high cost. This error source is eliminated with the new method via its own scoring plate.

The scoring plate can also take over the function of a clamping plate and stripping plate in addition to the scoring function.

BRIEF DESCRIPTION OF THE DRAWINGS

An embodiment of the invention is explained in more detail with the aid of drawings.

DETAILED DESCRIPTION OF THE PREFERRED EMBODIMENT

Figure 1:
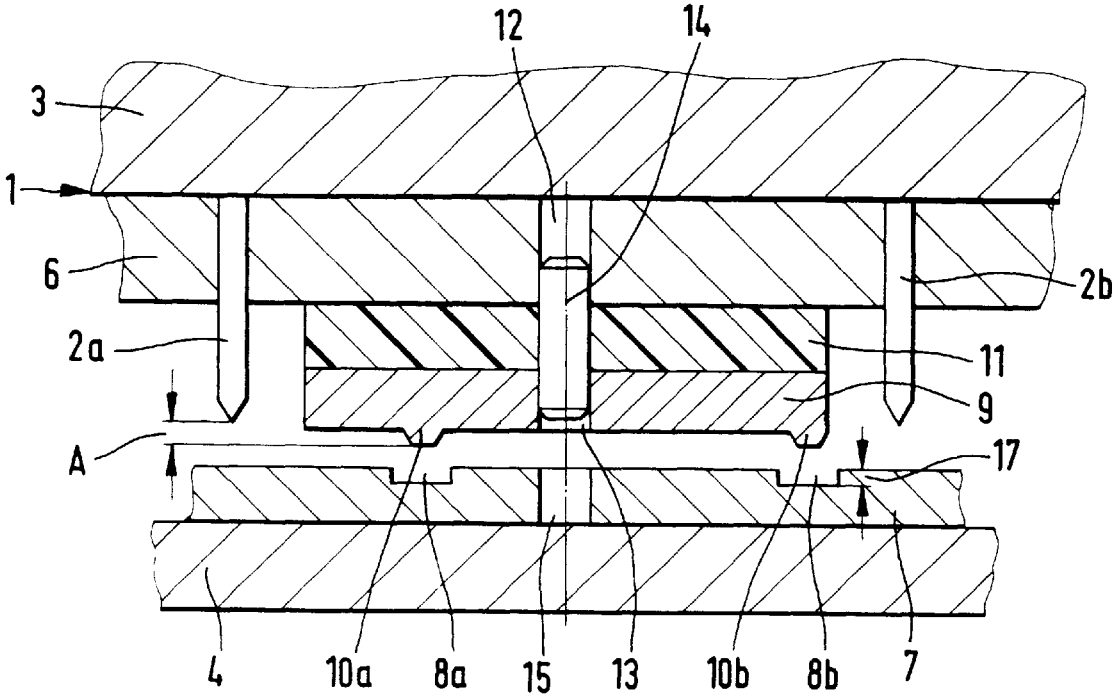
FIG. 1 shows a partial section through a punching and scoring tool of a punching machine in the area of a part to be scored and punched in a starting position.
Figure 2:
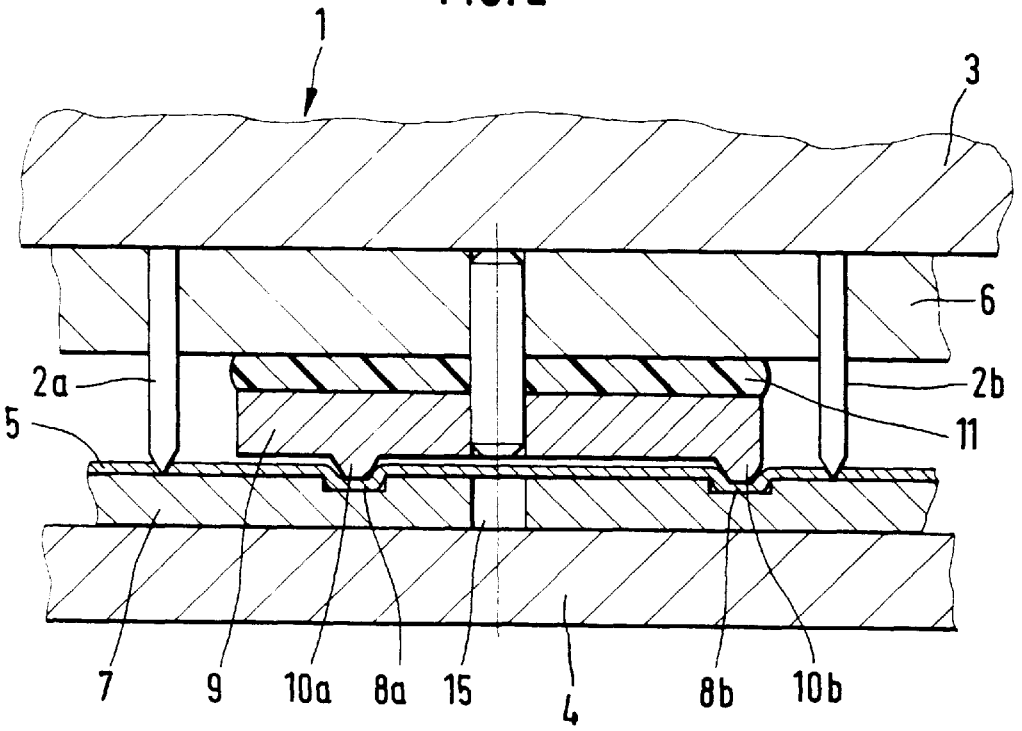
FIG. 2 shows the punching and scoring tool of FIG. 1 in an end position.

The punching and scoring tool 1 shown in FIGS. 1 and 2 is arranged between a pressure plate 3 and a counter-pressure plate 4 of a punching machine. The punching and scoring tool has a carrier board 6 consisting e.g. of wood laminate arranged horizontally in the punching machine and connected to the pressure plate 3, and a steel punching/scoring plate 7 connected to the counter-pressure plate 4 and arranged with a clearance below the carrier board 6.

Vertical slots are formed in the carrier board 6 to receive strip steel punching blades 2*a* and 2*b*.

An elastomer plate 11, on the underside of which a solid scoring plate 9 rests, is provided for each part to be scored and punched on the underside of the carrier board 6 between the punching blades 2*a*, 2*b*. The scoring plate 9 is provided with scoring projections (scoring elements) 10*a* and 10*b* on its underside facing the punching/scoring plate 7. In the initial position shown in FIG. 1 the free ends of the scoring projections 10*a*, 10*b* extend further downwards from the carrier board 6 than the free ends of the punching blades 2*a*, 2*b*.

The scoring plate 9 may be made of metal, plastic or composite. The scoring projections 10*a*, 10*b* can be formed by cutting out, etching out, insertion of bars or plates in the scoring plate 9. The scoring plate 9 offers the advantage that accurate positioning of the individual scoring elements 10*a*, 10*b* is determined not by the carrier board 6, but by the production of the scoring plate 9.

Scoring grooves 8*a* and 8*b*, into which the scoring projections 10*a* and 10*b* force folding box material during the punching/scoring process, are formed in the punching/scoring plate 7 opposite the scoring projections 10*a*, 10*b*.

The scoring plate 9 is provided with centring holes 13 (one shown), in each of which a centring pin 14 passing through the elastomer plate 11 and inserted in a hole 12 in the carrier board 6, is movably guided. The centring pins 14 ensure accurate centring of the scoring projections 10*a*, 10*b* of the scoring plate 9 with regard to the corresponding scoring grooves 8*a* or 8*b*, so that the best possible symmetrical arrangement of the scoring projections 10*a*, 10*b* with respect to the scoring grooves 8*a*, 8*b* is achieved.

For accurate fixing of the scoring plate 9 when setting up the punching and scoring tool 1 centring holes 15 (one shown), into which corresponding centring pins engage during the fixing, are provided in the punching/scoring plate 7.

After the accurate fixing on the punching/scoring plate 7 the corresponding centring holes 12 (one shown) are provided in the carrier board 6 and the scoring plate 9 is fixed by means of the centring pins 14 on the carrier board 6.

In the initial position of the punching and scoring tool 1 shown in FIG. 1 the scoring projections 10*a*, 10*b* extend further from the carrier board 6 than the punching blades 2*a*, 2*b* by the amount A (e.g. 0.3 mm). The distance of the scoring projections 10*a*, 10*b* from the punching/scoring plate 7 is adequate to introduce a cardboard sheet 5 (FIG. 2) between the scoring plate 9 and the punching/scoring plate 7.

After insertion of the cardboard sheet 5 the punching machine is closed, the pressure plate 3 moving with the carrier board 6 in the direction of the punching/scoring plate 7 until it reaches the end position shown in FIG. 2, in which the punching blades 2*a*, 2*b* cut through the cardboard and the scoring projections 10*a*, 10*b* have impressed scores.

Figure 3:
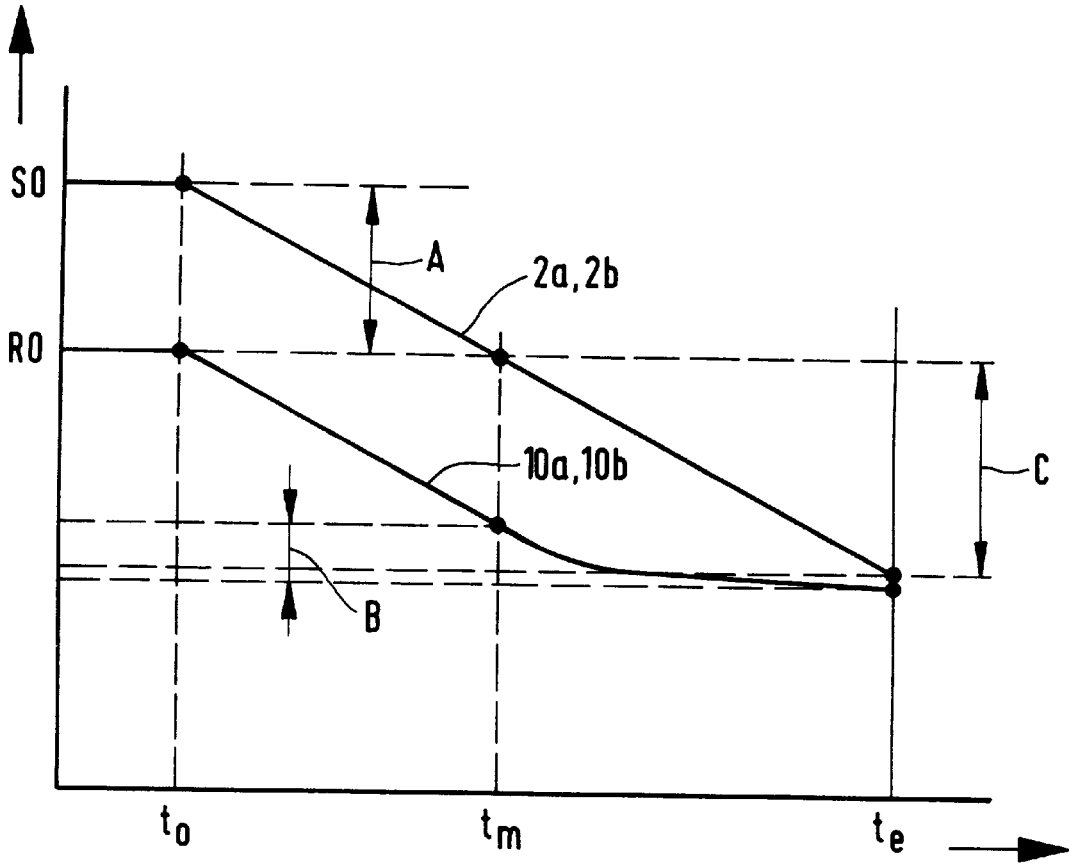
FIG. 3 shows a time/travel diagram of the movement of punching blades and scoring projections of the punching and scoring tool in FIG. 1.

The distance between the scoring projections 10*a*, 10*b* and the punching blades 2*a*, 2*b* during the punching/scoring process with the punching and scoring tool 1 according to the invention is shown in FIG. 3 in a time/travel diagram.

At the time $t_o$, at which the scoring projections 10*a*, 10*b* strike the cardboard, the scoring projections 10*a*, 10*b* are located at the height R0. At this time the free ends of the punching blades 2*a*, 2*b* are a distance A (FIG. 1) above the height R0 of the cardboard surface at the height S0.

Up to the time $t_m$, at which the punching blades 2*a*, 2*b* reach the cardboard surface (height R0), the distance A between the free ends of the punching blades 2*a*, 2*b* and the free ends of the scoring projections 10*a*, 10*b* is constant, i.e. the punching blades 2*a*, 2*b* and the scoring projections 10*a*, 10*b* are moved in synchronism. The scoring projections 10*a*, 10*b* have drawn the cardboard into the scoring grooves 8*a*, 8*b* at the time $t_m$. The resistance offered by the cardboard during this drawing in is lower than the restoring force of the elastomer plate 11 up to the time $t_m$.

From the time $t_m$, at which the compression of the cardboard in the scoring grooves 8*a*, 8*b* begins, the punching blades 2*a*, 2*b* and the scoring projections 10*a*, 10*b* move differently, because the resistance to the scoring projections 10*a*, 10*b* by the compression of the cardboard in conjunction with the reaction force of the scoring grooves 8*a*, 8*b* becomes larger than the restoring force of the elastomer plate 11, so that the elastomer plate 11 is compressed. The scoring projections 10*a*, 10*b* move from the time $t_m$ to time $t_e$, at which the punching blades 2*a*, 2*b* strike the punching/scoring plate 7 (FIG. 2) only by the amount B, whereas the punching blades 2*a*, 2*b* move linearly through the cardboard by the amount C, which corresponds to the thickness of the cardboard.

After the time $t_e$ the pressure plate 3 with the carrier board 6 is moved back to the initial position shown in FIG. 1. The punching cycle is terminated.

Instead of the elastomer plate 11 other flexible devices such as springs, rubber or pneumatic devices can be used.

The punching/scoring plate 7 can be designed in one piece with the counter-pressure plate 4.

The scoring groove depth 17 depends on the punched material and is selected in such a way that compression results.

The conventional punching method operates with the punching/scoring plate, in which the scoring grooves are provided in the punching plate. However, separately manufactured scoring projections arranged with respect to the grooves are often also affixed to the punching plate. This method is, of course, also possible with the new punching/scoring method.

The method and the punching and scoring tool according to the invention are described on the basis of production of a folding box blank from cardboard. However, they can be used in all punching and scoring work which is carried out with a punching die on cardboard, board, corrugated board, plastics or the like.

What is claimed is:

1. A method for producing scored punched parts from a material sheet, said method comprising the steps of:

forming scores in said material sheet by drawing material of said material sheet into scoring grooves formed in a counter-punching plate, said scoring grooves having groove bottoms, the material of said material sheet being drawn into said scoring grooves by means of scoring elements, and punching out parts by moving punching elements through said material sheet until said punching elements strike said counter-punching plate, wherein the step of forming scores further comprises causing said material drawn into said scoring grooves to contact said groove bottoms causing compression of said material between said scoring elements and said groove bottoms to begin by the time said punching elements first contact an upper surface of said material sheet.

2. A method for producing scored punched parts from a material sheet, said method comprising the steps of:

providing a carrier board having an underside on which punching elements and scoring elements are mounted, a punching/scoring plate arranged under said carrier board, the punching/scoring plate having scoring grooves which are positioned under said scoring elements, said scoring grooves having groove bottoms, said carrier board being vertically moveable with respect to said punching/scoring plate, said scoring elements having an initial position in which said scoring elements and said punching elements are spaced from said punching/scoring plate, said scoring elements in said initial position projecting farther from the underside of said carrier board toward said punching/scoring plate than said punching elements, said scoring elements mounted on said carrier board by vertically resilient means having a restoring force;

positioning the material sheet on an upper surface of said punching/scoring plate;

forming scores in said material sheet by drawing material of said material sheet into said scoring grooves by said scoring elements through movement of said carrier board carrying said scoring elements toward said punching/scoring plate;

punching out parts by moving said punching elements through said material sheet until said punching elements strike said punching/scoring plate;

wherein the step of forming scores further comprises causing said material drawn into said grooves to contact said groove bottoms causing compression of said material between said scoring elements and said groove bottoms to begin by the time said punching elements first contact an upper surface of said material sheet.

* * * * *